US007604467B2

(12) United States Patent
Prior

(10) Patent No.: US 7,604,467 B2
(45) Date of Patent: Oct. 20, 2009

(54) SUPERCHARGER WITH HOUSING INTERNAL NOISE ATTENUATION

(75) Inventor: Gregory P. Prior, Birmingham, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 229 days.

(21) Appl. No.: 11/530,639

(22) Filed: Sep. 11, 2006

(65) Prior Publication Data

US 2008/0060622 A1 Mar. 13, 2008

(51) Int. Cl.
*F01C 1/16* (2006.01)

(52) U.S. Cl. ..... 418/201.1; 418/157; 418/159; 123/559.1

(58) Field of Classification Search ..... None
See application file for complete search history.

(56) References Cited

U.S. PATENT DOCUMENTS 6,589,034 B2 * 7/2003 Vorwerk et al. ..... 418/15

FOREIGN PATENT DOCUMENTS

DE 3531353 A1 * 3/1987 ..... 123/559.1

* cited by examiner

*Primary Examiner*—Thomas Denion
*Assistant Examiner*—Douglas J. Duff

(57) ABSTRACT

A positive displacement supercharger includes a housing defining a rotor cavity with a pair of positive displacement rotors operative to carry air axially from an inlet end to an outlet in the cavity wall near an outlet end of the cavity. The outlet communicates with an outlet plenum partially defined by the cavity wall. The cavity wall includes a stiff portion defining a plurality of lightening recesses, such as a waffle pattern, limiting distortion of the wall by pulsations in the plenum. The recesses may be time and cost efficiently converted to Helmholtz tuners by covering the recesses with a cover plate, which may be perforated to include at least one tuning opening (perforation) into each tuning chamber (recess) and forming tuning volumes of the tuning chambers and their associated tuning openings effective to attenuate selected frequencies of pulsations in the plenum and thereby reduce undesired noise emanating from the air system of the supercharger.

6 Claims, 5 Drawing Sheets

SUPERCHARGER WITH HOUSING INTERNAL NOISE ATTENUATION

TECHNICAL FIELD

This invention relates to positive displacement compressors or superchargers, such as roots type or screw compressors utilized for automotive engine superchargers and other purposes.

BACKGROUND OF THE INVENTION

It is known in the art to utilize positive displacement compressors having lobed rotors for supercharging internal combustion engines and for providing compressed air for other purposes. Such a compressor used as an automotive supercharger may include a housing having a rotor cavity in which a pair of parallel rotors having interleaved lobes rotate to effect compression of air discharged through an opening in the cavity wall near an outlet end of the housing. The rotors may be belt driven by the engine through a pulley connected directly, or through a gear train, to the pair of rotors. A closure may be mounted on the housing to contain the compressed air before discharging it air through the housing or otherwise to the engine air intake and associated cylinders.

Between the housing and the closure, an outlet plenum is formed which receives the compressed air from the rotors through an outlet near an outlet end of the cavity. The plenum is subject to pulsations created by the pumping action of the rotors. Accordingly, the outlet side of the housing wall is desirably stiffened by providing a cross-ribbed pattern or grid similar to a waffle. The ribs provide a stiffened portion to reduce flexing of the rotor wall. The waffle pattern results in a plurality of lightening recesses in the wall to reduce its mass and the weight of the housing.

The pulsations created in the plenum react with the air induction system of the engine, particularly within the rotor housing an plenum, to cause vibrations of the structure that result in undesired noise of various frequencies, which it is desired to minimize.

SUMMARY OF THE INVENTION

Attenuation of high frequency noises in engine induction systems, especially with superchargers, is sometimes provided by adding quarter wave tuners or Helmholtz tuners. Higher frequency Helmholtz tuners are very small and any significant attenuation requires a number of small tuning volumes. These tuning volumes require space in the induction system as well as added materials to create the tuning volumes and connect them in the system.

In accordance with the invention, a plurality of internal Helmholtz tuners are provided near the source of the pulsations in the supercharger outlet plenum. A perforated plate or similar cover is mounted over the waffle pattern of recesses formed in an outer surface of the cavity wall. The plate acts to restrict access to the recesses and to form a number of Helmholtz tuners. These include tuning chambers formed by the recesses and connected with the plenum by passages formed by the perforations in the cover plate. The tuners provide spring mass systems in which the mass of air in the inlet opening of each tuner vibrates against the volume of air within the associated tuning chamber, which acts as a pneumatic spring to provide attenuation of one or more specific frequencies within the outlet plenum depending upon the specific tuning frequencies of the various tuners formed within the rotor housing.

The invention provides an efficient and low cost means for attenuating noise creating pulsations using pre-existing or modified waffle pattern recesses to form tuning chambers by the addition of a suitable perforated cover plate.

These and other features and advantages of the invention will be more fully understood from the following description of certain specific embodiments of the invention taken together with the accompanying drawings.

DESCRIPTION OF AN EXEMPLARY EMBODIMENT

Figure 1:
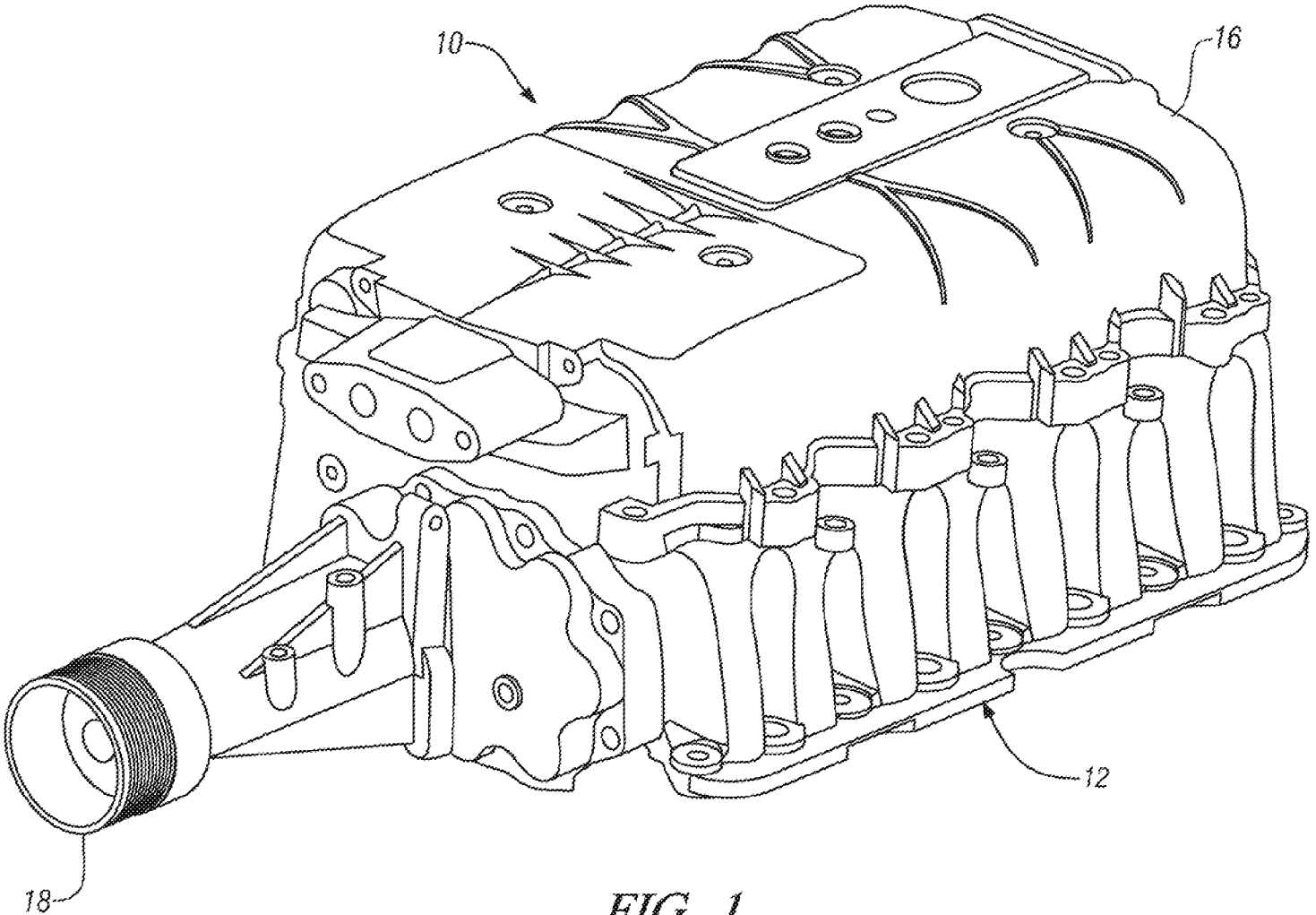
FIG. 1 is a pictorial view of an engine supercharger assembly according to the invention.

Referring now to the drawings in detail, numeral 10 generally indicates a positive displacement compressor or supercharger for use with a V-type internal combustion engine. Supercharger 10 includes a rotor housing 12 containing a drive and rotor assembly 14 and mounting an upper housing closure 16. The rotor assembly is belt driven through a pulley 18 connected to a rotor drive shaft 20 extending from a gear case 22 of the drive and rotor assembly 14.

Figure 2:
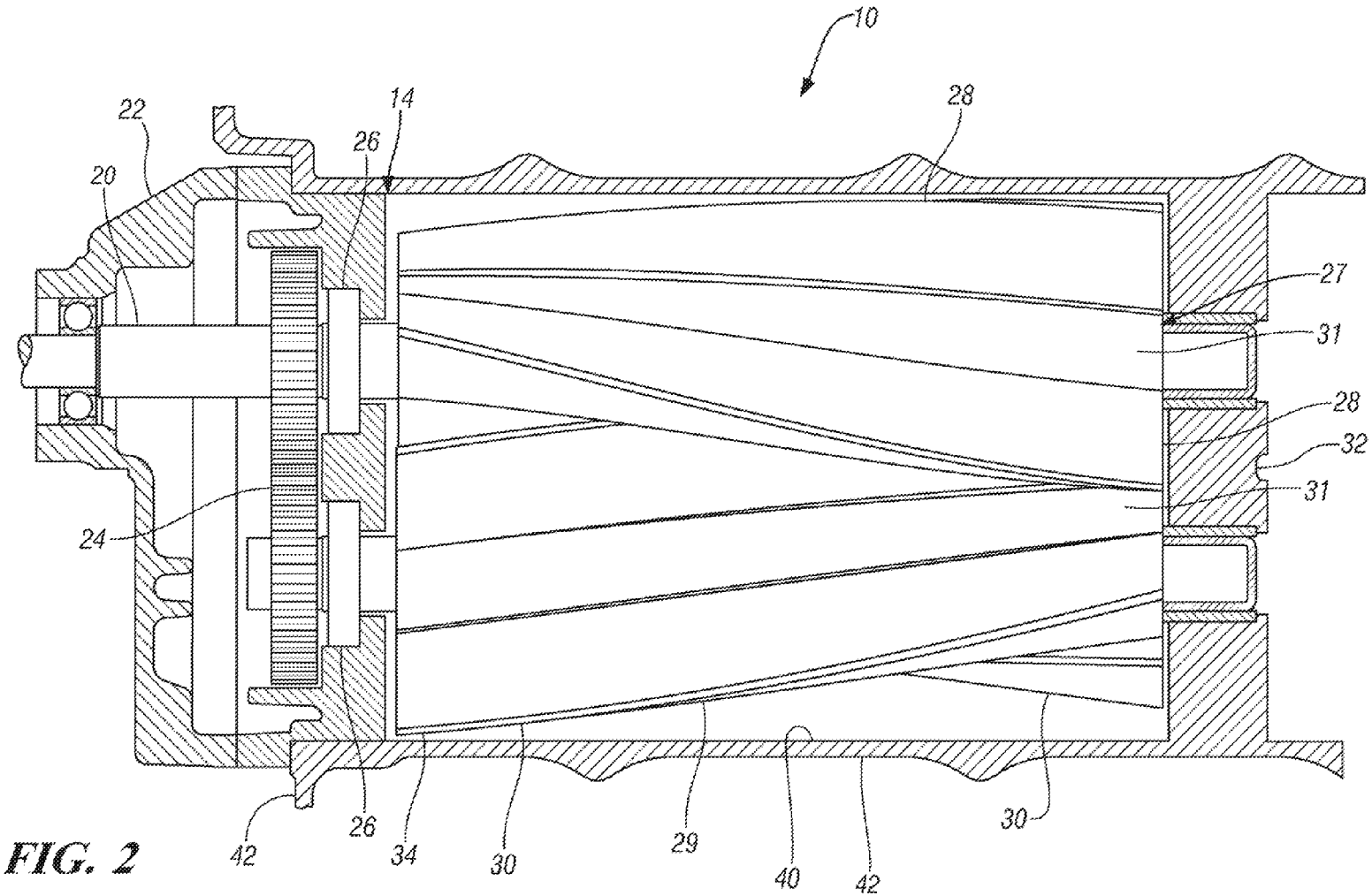
FIG. 2 is a partial cross-sectional view showing a rotor and drive assembly mounted within the supercharger of FIG. 1.

FIG. 2 illustrates the drive and rotor assembly 14, which includes the gear case 22 carrying a gear train 24 and bearings 26 which drive and support a pair of oppositely rotating drive and driven rotors 27, 29. The rotors are of the helical Roots type having, respectively, interleaved clockwise and counterclockwise helical lobes 28, 30. These co-act to form rotor chambers 31 that carry charging air from an inlet end 32 toward an outlet end 34 of the housing. Alternatively, screw type helical rotors could be used in the supercharger.

Figure 3:
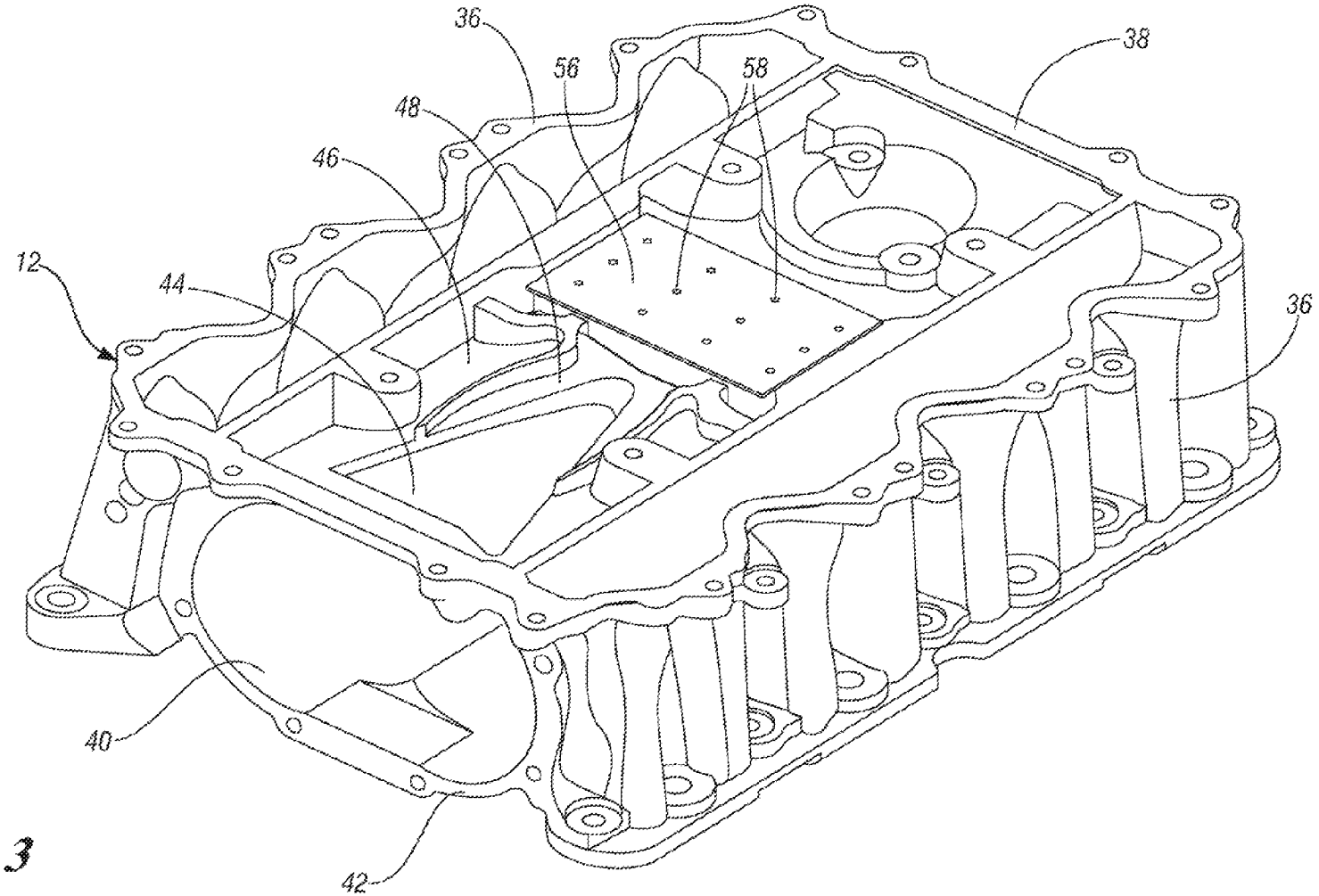
FIG. 3 is an isometric view of the housing for the supercharger of FIG. 1.
Figure 4:
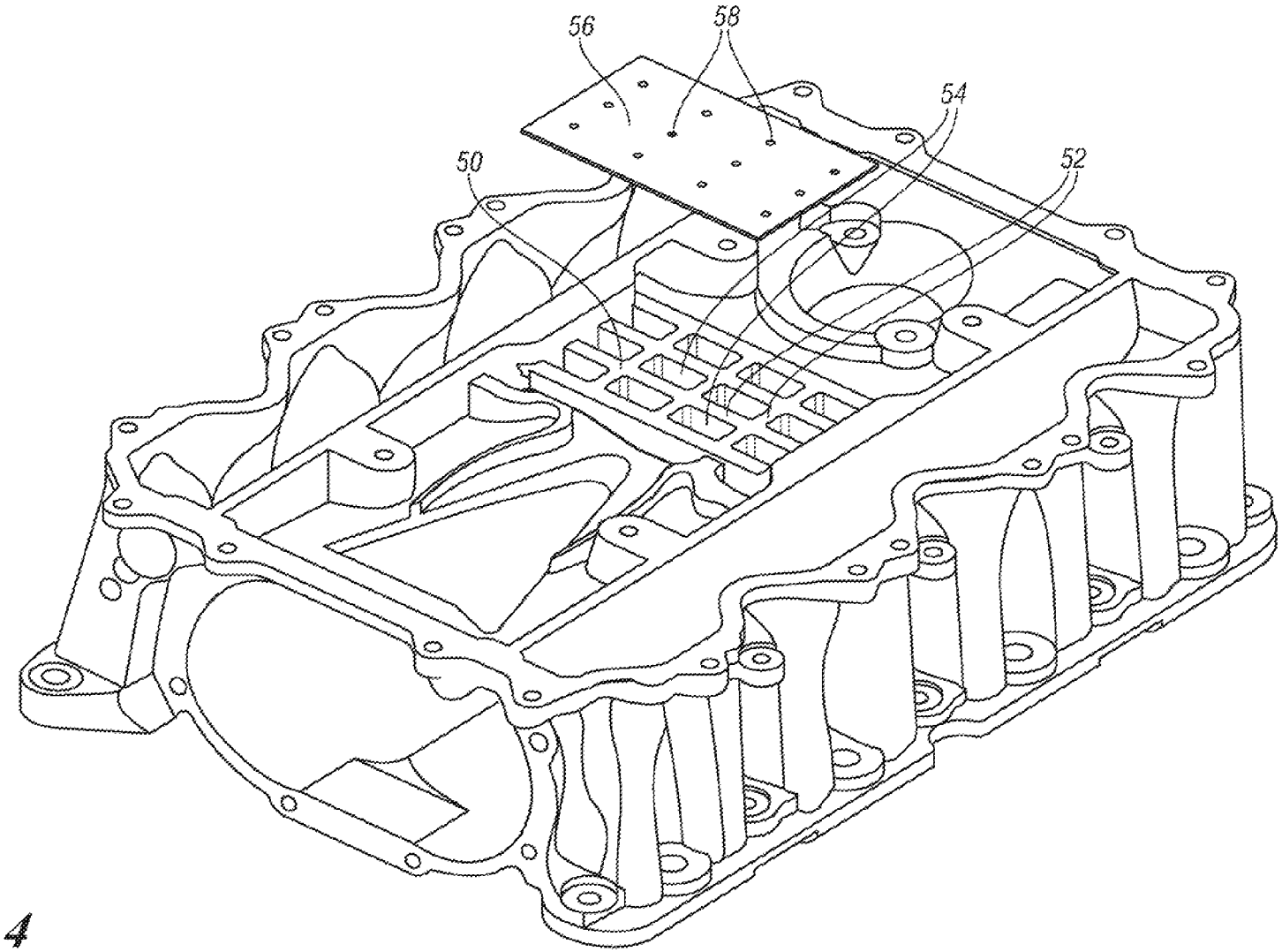
FIG. 4 is an exploded view of the housing and plate assembly of FIG. 3.

FIGS. 3 and 4 illustrate assembly and exploded views respectively of the rotor housing 12. Housing 12 includes a pair of outer sidewalls 36 and an inlet end wall 38. An internal rotor cavity 40 is defined by a cavity wall 42. An outlet opening 44 extends through the wall 42, which communicates the rotor cavity 40 with an outlet plenum 46 extending along an other side 48 of the cavity wall 42 under the closure 16.

As shown in the exploded view of FIG. 4, a central part of the wall outer side 48 is formed as a stiff portion 50 defined by a pattern of cross ribs 52 which form a plurality of elongated recesses 54. The recesses are closed by restriction means in the form of a cover plate 56, which includes a plurality of perforations 58, at least one connected with each recess. The recesses form tuning chambers 60, which join with the perforations 58 acting as tuning openings to form Helmholtz tuners 62.

Figure 5:
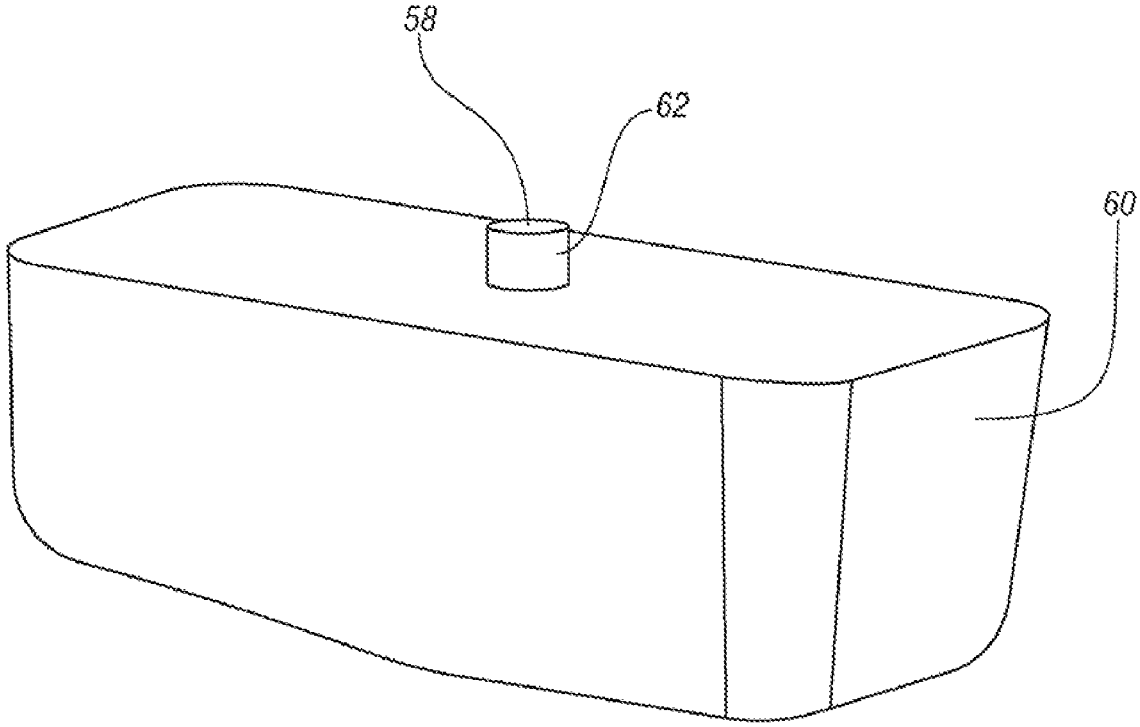
FIG. 5 is an enlarged view of a single tuning volume forming a Helmholtz resonator in one of the waffle pattern recesses of the housing of FIG. 4.

One exemplary Helmholtz tuner is shown by FIG. 5 as the tuning volumes shown in positive space of an associated tuning chamber 60 and its tuning opening 58 shown as a protrusion. The protrusion represents the volume occupied, by the mass of air present in the tuning opening 58 at any time. The comparative volume of the tuning chamber is shown by the larger mass 60 acting as a spring, while the air mass in tuning opening 58 acts as a mass in the mass/spring tuner.

The Helmholtz tuners may be designed or adjusted to attenuate the same or different resonant frequencies of pulsations by varying the volumes of the recesses or varying the thickness of the cover plate or the diameters of the holes or perforations 58. In addition, more than one perforation could be connected with a single chamber in order to obtain a different frequency range. The tuners 62 could be designed for attenuating a single frequency or could be individually tuner to more than one frequency in order to obtain a desirable tuning result for the interior of the plenum and the resulting reduction of pulsations therein.

In operation, air pulsations created in the outlet plenum 46 may be attenuated, at least in part, by one or more Helmholtz tuners formed by the combined waffle pattern with its associated cover plate 56. The tuners provide opposing frequency pulsations that attenuate the pulsations of air within the plenum near their source and thus reduce the noise caused by pulsations within the plenum.

The invention takes advantage of a stiffening pattern, such as a waffle pattern, which may be already formed within the outer side of the rotor cavity wall in order to stiffen it against reaction to pulsations. The pattern is converted to Helmholtz tuners by merely placing restriction means, such as a cover or plate, over the waffle pattern and providing the necessary size and number of tuning openings in the form of perforations through the cover or plate to obtain the desired frequency attenuation. The assembly is thus economically efficient, in that it uses an already existing structural element of the housing in order to form the tuning chambers with a minimum of increased weight and cost.

If desired, the waffle pattern may be modified in order to provide attenuation of additional or alternative frequencies without increasing significantly the cost of the improved supercharger rotor housing 12. In another variation, the tuning openings could be formed by tubes extending through the cover plate to provide longer tuning volumes. Alternatively, if the pattern allows, some or all of the tuning openings could extend around the cover plate, such as through notches in or passages through the cavity wall.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. A positive displacement supercharger comprising:

a housing including a rotor cavity having a surrounding cavity wall;

a pair of positive displacement rotors oppositely rotatable in the rotor cavity and having interleaved helical lobes forming rotor chambers operative to carry air axially from an inlet at an inlet end of the cavity to an outlet near an outlet end of the cavity;

the outlet defined by an opening through the cavity wall and communicating the rotor chambers with an outlet plenum partially defined by an outer side of the cavity wall and subject to pulsations in the air discharged to the outlet plenum;

the cavity wall being stiffened within the plenum by a stiff portion defining a plurality of lightening recesses opening into the plenum, the stiff portion limiting distortion of the wall by pulsations in the plenum; and restriction means partially covering the openings into the plenum of at least some of the recesses and forming tuning chambers, the restriction means including at least one tuning opening between each tuning chamber and the plenum and forming tuning volumes effective to attenuate selected frequencies of pulsations in the plenum and thereby reduce undesired noise emanating from the discharge air of the supercharger;

wherein the restriction means includes a cover over at least part of the stiff portion and blocking air flow to the tuning chambers under the cover except through the tuning openings, and the tuning openings extend through the cover.

2. A supercharger as in claim 1 wherein the cover is a plate.

3. A supercharger as in claim 1 wherein the stiff portion is ribbed.

4. A positive displacement supercharger comprising:

a housing including a rotor cavity having a surrounding cavity wall;

a pair of positive displacement rotors oppositely rotatable in the rotor cavity and having interleaved helical lobes forming rotor chambers operative to carry air axially from an inlet at an inlet end of the cavity to an outlet near an outlet end of the cavity;

the outlet defined by an opening through the cavity wall and communicating the rotor chambers with an outlet plenum partially defined by an outer side of the cavity wall and subject to pulsations in the air discharged to the outlet plenum;

the cavity wall being stiffened within the plenum by a stiff portion defining a plurality of lightening recesses opening into the plenum, the stiff portion limiting distortion of the wall by pulsations in the plenum; and restriction means partially covering the openings into the plenum of at least some of the recesses and forming tuning chambers, the restriction means including at least one tuning opening between each tuning chamber and the plenum and forming tuning volumes effective to attenuate selected frequencies of pulsations in the plenum and thereby reduce undesired noise emanating from the discharge air of the supercharger; wherein the stiff portion is cross-ribbed in a waffle pattern.

5. A supercharger as in claim 4 wherein the tuning volumes define Helmholtz tuners.

6. A positive displacement supercharger comprising:

a housing including a rotor cavity having a surrounding cavity wall;

a pair of positive displacement rotors oppositely rotatable in the rotor cavity and having interleaved helical lobes forming rotor chambers operative to carry air axially from an inlet at an inlet end of the cavity to an outlet near an outlet end of the cavity;

the outlet defined by an opening through the cavity wall and communicating the rotor chambers with an outlet plenum partially defined by an outer side of the cavity wall and subject to pulsations in the air discharged to the outlet plenum;

the cavity wall being stiffened within the plenum by a stiff portion defining a plurality of lightening recesses opening into the plenum, the stiff portion limiting distortion of the wall by pulsations in the plenum; and restriction means partially covering the openings into the plenum of at least some of the recesses and forming tuning chambers, the restriction means including at least one tuning opening between each tuning chamber and the plenum and forming tuning volumes effective to attenuate selected frequencies of pulsations in the plenum and thereby reduce undesired noise emanating from the discharge air of the supercharger;

wherein the supercharger housing is efficiently produced by:

providing a rotor housing for a positive displacement supercharger of a design that includes a stiff wall portion forming a part of an outlet plenum and including cross-ribbed stiffeners defining recesses arranged in a pattern; and applying a perforated cover plate closing the openings of the recesses into the plenum portion with the perforations in the plate communicating between the recesses and the plenum portion and proportioned to form volumes effective to a attenuate selected frequencies of pulsations in the plenum and thereby reduce undesired noise emanating from discharge air of an associated supercharger.

* * * * *